United States Patent [19]

Yamori et al.

[11] Patent Number: 4,812,438

[45] Date of Patent: Mar. 14, 1989

[54] HEAT-SENSITIVE RECORDING MATERIAL

[75] Inventors: Tsunefumi Yamori; Shigekazu Shuku; Hironari Fujioka, all of Hyogo, Japan

[73] Assignee: Kanzaki Paper Mfg. Co., Ltd., Tokyo, Japan

[21] Appl. No.: 51,599

[22] Filed: May 20, 1987

[30] Foreign Application Priority Data

May 29, 1986 [JP] Japan ..... 61-124562

[51] Int. Cl.[4] ..... B41M 5/18

[52] U.S. Cl. ..... 503/200; 427/152; 428/913; 428/914; 503/226

[58] Field of Search ..... 427/150–152; 503/200, 226; 428/913, 914

[56] References Cited

U.S. PATENT DOCUMENTS 4,370,370 1/1983 Iwata et al. ..... 503/226
4,484,204 11/1984 Yamamoto et al. ..... 503/226

FOREIGN PATENT DOCUMENTS 54-128347 10/1979 Japan .
0199189 11/1983 Japan ..... 503/226
59-26291 2/1984 Japan .
0222383 12/1984 Japan ..... 503/226

*Primary Examiner*—Bruce H. Hess
*Attorney, Agent, or Firm*—Finnegan, Henderson, Farabow, Garrett & Dunner

[57] ABSTRACT

A heat-sensitive recording material is disclosed, comprising a support; a heat-sensitive recording layer formed on the support, which contains a color former and a color developer which forms a color upon contact with said color former; an interlayer with a Bekk smoothness of from 50 to 1,500 seconds formed on said heat-sensitive recording layer, which contains a water-soluble resin; and an overcoat layer formed on the interlayer, which contains a resin that is curable upon exposure to electron beams. The heat-sensitive recording material exhibits not only superior recording characteristics but also good preservability of recorded images, with widely varying surface characteristics ranging from a high gloss to a matted appearance.

6 Claims, No Drawings

HEAT-SENSITIVE RECORDING MATERIAL

FIELD OF THE INVENTION

The present invention relates to a heat-sensitive recording material, and more particularly, to a heat-sensitive recording material having an overcoat layer with wisely varying surface characteristics ranging from a high gloss to a matted appearance, which exhibits not only superior recording characteristics but also good preservability of recorded images.

BACKGROUND OF THE INVENTION

Hitherto, a heat-sensitive recording material which utilizes a coloring reaction of a color former and a color developer which forms a color upon contact with the color former and provides a color image by contacting both coloring materials by the action of heat is well known.

Such heat-sensitive recording materials are comparatively inexpensive and can be used on a recording equipment that is compact and requires fairly easy maintenance. Because of these advantages, heat-sensitive recording materials are extensively used as recording media in a wide range of applications including facsimile equipments and various types of computers. One major problem with heat-sensitive recording materials is, however, their low resistance to fingerprints or solvents; if the recording layer comes in contact with a sebum of human being or a solvent, the color density of characters to be attained is decreased or an unwanted coloration ("background fog") occurs.

With a view to solving this problem, several methods have been proposed; in one method, a heat-sensitive recording layer is coated with an aqueous emulsion of a resin having film-forming properties and resistance to chemicals (Japanese Patent Application (OPI) No. 128347/79); and in another method, a heat-sensitive recording layer is coated with a water-soluble high molecular weight compound such as polyvinyl alcohol (Japanese Utility Model Application (OPI) No. 125354/81). The term "OPI" as used herein means "unexamined published application". However, the methods so far proposed either suffer from additional problems or find themselves incapable of achieving the intended results to satisfactory levels. For instance, in the method in which an aqueous resin coating is applied to the heat-sensitive recording layer, the temperature for drying has to be limited to a certain level in order to avoid unwanted coloration of the recording layer due to high-temperature drying, whereby curing of the resin layer inevitably becomes insufficient for preventing its sticking to a recording head during the recording. In order to avoid this problem, a method in which a heat-sensitive recording layer is coated with a resin component capable of curing upon exposure to electron beams and the coated resin component is cured upon exposure to electron beams is proposed. However, the resulting heat-sensitive recording material is still unsatisfactory in terms of preservability of recorded images. In addition, there may also be problems that the electron beam-curable resin layer causes coloration of the heat-sensitive recording layer just after it has been coated or causes fading of recorded images.

Attaching heat-sensitive recording materials to commercial goods has recently become a widespread practice, and in order to enhance the aesthetic appeal of the recording materials to thereby increase their commercial value as labels, it is desirable that the recording materials have either a high gloss or matted surface characteristics. This requirement is not fully met by the recording layer of existing heat-sensitive recording materials unless they are provided with an overcoat layer. However, the gloss attained by coating a heat-sensitive recording layer directly with an electron beam-curable resin layer as described above is not high enough to provide an increased commercial value for the product.

SUMMARY OF THE INVENTION

Under these circumstances, the present inventors made concerted efforts to develop a heat-sensitive recording material having an overcoat layer with widely varying surface characteristics ranging from a high gloss to a matted appearance, which exhibits not only superior recording characteristics but also good preservability of recorded images. As a result, the present inventors have found that the stated object can be attained by coating a heat-sensitive recording layer with an interlayer having a surface smoothness in a specified range and by then providing an overcoat layer that contains a resin which is curable upon exposure to electron beams (such a resin is hereunder sometimes referred to as "electron beam-curable resin"). The present invention has been accomplished on the basis of this finding.

The present invention provides a heat sensitive recording material comprising a support; a heat-sensitive recording layer formed on the support, which contains a color former and a color developer which forms a color upon contact with the color former; an interlayer with a Bekk smoothness as defined by TAPPI Standard T479 om-81 of from 50 to 1,500 seconds formed on the heat-sensitive recording layer, which contains a water-soluble resin; and an overcoat layer formed on the interlayer, which contains a resin that is curable upon exposure to electron beams.

DETAILED DESCRIPTION OF THE INVENTION

There is no particular limitation on the possible combination of color formers and color developers that are to be incorporated in the heat-sensitive recording layer of the heat-sensitive recording material of the present invention, and any combination that undergoes a coloring reaction as a result of contact between the both coloring materials by the action of heat may be employed. Illustrative combinations are those of colorless or pale-colored basic dyes and inorganic or organic acidic substances, and those of metal salts of higher fatty acids (e.g., ferric stearate) and phenols (e.g., gallic acid).

Particularly good results are attained in terms of preservability of recorded images if the overcoat layer specified herein is used with the combination of a basic dye and an acidic substance.

Various types of colorless or pale-colored basic dyes are known. Examples include triarylmethane-based dyes such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, and 3-p-dimethylaminophenyl-3-(1-methylpyrrole-3-yl)-6-dimethylaminophthalide; diphenylmethane-based dyes such as 4,4'-bisdimethylaminobenzhydrylbenzylether, N-halophenyl-leucoauramines, and N-2,4,5-trichlorophenyl-leucoauramine; thiazine-based dyes such as benzoyl-leucomethyleneblue and p-nitrobenzoylleucomethyleneblue; spiro-based dyes such as 3-methylspiro-dinaphthopyran, 3-ethyl-spiro-dinahpthopyran, 3-phenyl-spiro-dinaphthopyran, 3-benzylspiro-dinaphthopyran, 3-methyllnaphtho(6'-methoxybenzo)spiro-pyran, and 3-propyl-spiro-dibenzopyran; lactam-based dyes such as rhodamine-B-anilinolactam, rhodamine(p-nitro-anilino)lactam, and rhodamine(o-chloroanilino)lactam; and fluoran-based dyes such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-N-dietylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethyoxyphenylamino)fluoran, 3-(N-ethyl-N-isoamylamino)-6-methyl-7-phenylaminofluoran, 3-(n-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, and 3-pyrrolidino-6-methyl-7-p-butylphenylaminofluoran. The present invention is not limited to these exemplified basic dyes. Rather, these basic dyes can be used either alone or in admixture with each other or with other dyes known to be useful in heat-sensitive recording materials.

Various types of inorganic or organic acidic substances are also known as a color developer which forms a color upon contact with the colorless or pale-colored basic dye. Examples include inorganic acidic substances such as activated clay, acid clay, attapulgite, bentonite, colloidal silica, and aluminum silicate; and organic acidic substances including phenolic compounds such as 4-tert-butylphenol, 4-hydroxydiphenoxide, α-naphthol, β-naphthol, 4-hydroxyacetophenol, 4-tert-octylcatechol, 2,2'-dihydroxydiphenol, 2,2'-methylenebis(4-methyl-6-tert-isobutylphenol), 4,4'-isopropylidenebis(2-tert-butylphenol), 4,4'-sec-butylidenediphenol, 4-phenylphenol, 4,4'-isopropylidenediphenol (bisphenol A), 2,2'-methylenebis(4-chlorophenol), hydroquinone, 4,4'-cyclohexylidenediphenol, benzyl 4-hydroxybenzoate, dimethyl 4-hydroxyphthalate, hydroquinone monobenzylether, novolak type phenol resins, and phenol polymers; aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(60 methylbenzyl)salicylic acid, 3,5-di-tert-butylsalicylic acid, 3-phenyl-5-(60, α-dimethylbenzyl)salicylic acid, and 3,5-di-α-methylbenzylsalicylic acid; and salts of such phenolic compounds or aromatic carboxylic acids with polyvalent metals such as zinc, magnesium, aluminum, calcium, titanium, manganese, tin, and nickel.

The proportion of the color former to the color developer used in the recording layer of the heat-sensitive recording material of the present invention is not limited to any particular values and may be appropriately selected in accordance with the specific types of color former and developer employed. As a guide, from 1 to 50 parts by weight, preferably from 1 to 10 parts by weight, of the acidic substance may be used per part by weight of the colorless or pale-colored basic dye.

A coating composition containing these substances may be prepared by dispersing the above-listed color former and developer, either as an admixture or independently, in a dispersion medium, which is typically water, by means of a suitable stirrer/grinder such as a ball mill, an attritor, or a sand mill.

The coating composition may contain a binder in an amount of foam about 10 to about 40 wt%, preferably from 15 to 30 wt%, of the total solids content of the coating composition. An appropriate binder is selected from among: starches, hydroxethyl cellulose, methyl cellulose, carboxymethyl cellulose, gelatin, casein, gum arabic, polyvinyl alcohol, diisobutylene/maleic anhydride copolymer salts, styrene/maleic anhydride copolymer salts, ethylene/acrylic acid copolymer salts, styrene/acrylic acid copolymer salts, and styrene/-butadiene copolymer emulsions.

The coating composition may further contain a variety of auxiliary agents such as dispersants (e.g., sodium dioctylsulfosuccinate, sodium dodecylbenzenesulfonate, sodium salts of lauryl alcohol sulfuric acid esters, alginic acid salts, and metal salts of fatty acids), ultraviolet light absorbers (e.g., benzophenone- and triazole-based compounds), defoaming agents, fluorescent dyes, and coloring dyes.

Other additives that may be incorporated in the coating composition include: lubricants such as zinc stearate, calcium stearate, polyethylene wax, carnauba wax, paraffin wax, and ester waxes; inorganic pigments such as kaolin, clay, talc, calcium carbonate, calcined clay, titanium oxide, diatomaceous earth, fine granular anhydrous silica, and activated clay; and sensitizers such as stearic acid amide, stearic acid methylenebisamide, oleic acid amide, palmitic acid amide, sperm oleic acid amide, and coconut fatty acid amide.

The method that can be employed to form the recording layer of the heat-sensitive recording material of the present invention is not limited in any particular way, and any known conventional techniques may be used. For instance, the coating composition may be applied onto a support by such methods as bar coating, air-knife coating, rod blade coating, pure blade coating, and short-dwell coating and subsequently dried. The amount in which the coating composition is applied is not limited to any particular value, but it generally ranges from about 2 to 12 g/m$^2$, preferably from 3 to 10 g/m$^2$, on a dry weight basis.

As the support which is used in the present invention, paper, synthetic resin films, and nonwoven fabric sheets can be used, but paper is especially preferably used because of its good coating adaptability and low cost.

In accordance with the present invention, the heat-sensitive recording layer thus formed is then coated with an interlayer having a specified surface smoothness. Suitable examples of the water-soluble resin to be incorporated in the interlayer include completely or partially saponified polyvinyl alcohols; acetoacetylated polyvinyl alcohols in which an acetoacetyl group has been introduced by reaction between polyvinyl alcohol and diketene, etc.; reaction products of polyvinyl alcohol and polycarboxylic acids such as fumaric acid, phthalic anhydride, trimellitic anhydride, and itaconic anhydride, or esterified products of these reaction products; carboxy-modified polyvinyl alcohols obtained as saponification products of copolymers of vinyl acetate and ethylenically unsaturated carboxylic acids such as maleic acid, fumaric acid, itaconic acid, crotonic acid, acrylic acid, and methacrylic acid; sulfonic acid-modified polyvinyl alcohols obtained as saponification products of copolymers of vinyl acetate and olefinic sulfonic acids such as ethylenesulfonic acid and allylsulfonic acid or salts thereof; olefin-modified polyvinyl alchohols obtained by saponifying copolymers of vinyl acetate and olefins such as ethylene, propylene, isobutylene, α-ocetene, α-dodecene, and α-octadodecene; nitrile-modified polyvinyl alcohols obtained as saponification products of copolymers of vinyl acetate and nitriles such as acrylonitrile and methacrylonitrile; amide-modified polyvinyl alcohols obtained by saponifying copolymers of vinyl acetate and amides such as acrylamide and methacrylamide; pyrrolidone-modified polyvinyl alcohols obtained by saponifying copolymers of vinyl acetate and N-vinylpyrrolidone; cellulose derivatives such as methyl cellulose, ethyl cellulose, hydroxyethyl cellulose, and carboxymethyl cellulose; casein; gum arabic; and starches such as oxidized starch, etherified starch, dialdehyde starch, and esterified starch.

Among the water-soluble resins listed above, various modified polyvinyl alcohols, cellulose derivatives, and casein are preferable, with acetoacetylated polyvinyl alcohols and carboxy-modified polyvinyl alcohols being particularly preferable.

The interlayer of the present invention, if desired, may further be incorporated with a water-dispersible resin such as a styrene/butadiene copolymer emulsion, a vinyl acetate/vinyl chloride/ethylene copolymer emulsion, and a methacrylate/butadiene copolymer emulsion.

Pigments may be incorporated in the interlayer in order to increase its smoothness. Specific examples of useful pigments include inorganic pigments such as calcium carbonate, zinc oxide, aluminum oxide, titanium dioxide, silicon dioxide, aluminum hydroxide, barium sulfate, zinc sulfate, talc, kaolin, clay, calcined clay, and colloidal silica; and organic pigments such as micro balls of polystyrene, nylon powder, polethylene powder, urea/formaldehyde resin filler, and raw starch granules. These pigments are generally incorporated in the interlayer in amounts of from about 5 to 500 parts by weight, preferably from 80 to 350 parts by weight, based on 100 parts by weight of the resin component.

The coating composition for forming the interlayer may optionally contain a curing agent selected from among, for example, glyoxal, methylolmelamine, potassium persulfate, ammonium persulfate, sodium persulfate, ferric chloride, magnesium chloride, boric acid, and ammonium chloride. If required, the coating composition may further contain a variety of auxiliary agents such as lubricants (e.g., zinc stearate, calcium stearate, stearic acid amide, polyethylene wax, carnauba wax, paraffin wax, and ester waxes), surfactants (e.g., sodium dioctylsulfosuccinate, sodium dodecylbenzenesulfonate, sodium salts of lauryl alcohol sulfuric acid esters, alginic acid salts, and metal salts of fatty acids), ultraviolet light absorbers (e.g., benzophenone- and triazole-based compounds), defoaming agents, fluorescent dyes, and coloring dyes.

The coating composition for forming the interlayer is generally prepared as an aqueous system and, after optional mixing by means of a suitable mixer/stirrer such as a mixer, an attritor, a ball mill, or a roll mill to obtain a desired dispersion, the coating composition is applied onto the heat-sensitive recording layer by any known coating methods. After its application, the interlayer is dried by conventional drying means or by exposure to ultraviolet rays or electron means.

If a curing agent is used in combination, it may be incorporated in the coating composition for forming the interlayer. Alternatively, the curing agent may be coated separately from the coating composition for forming the interlayer, and this has the advantage of permitting a strong curing agent to be selected without worrying about the pot life of the coating composition.

If desired, a coating layer of the same type as the interlayer may be formed on the back side of the heat-sensitive recording material for the purpose of providing it with enhanced preservability of recorded images. Any of the processing techniques known in the art of manufacturing heat-sensitive recording materials may additionally be performed. For instance, a resin which is non-curable or curable upon exposure to electron beams may be coated on the backside of a support so as to prevent the recorded material from occurrence of curling; the recording material may be subjected to electroconductive processing so as to enhance the running properties; a subbing layer may be formed on a support; or an adhesive may be applied to the backside of the recording material so as to make an adhesive label.

The amount in which the coating composition for forming the interlayer is applied is not limited to any particular value. However, if the coating composition is applied in an amount of less than 0.1 g/m$^2$, the intended effects of the present invention are not fully attained. If the coating composition is applied in an amount exceeding 20 g/m$^2$, the recording sensitivity of the resulting heat-sensitive recording material may be reduced markedly. Therefore, the coating composition for the interlayer is generally applied in an amount of from about 0.1 to 20 g/m$^2$, preferably from 0.5 to 10 g/m$^2$ on a dry basis.

The smoothness of the thus formed interlayer is critical to the purposes of the present invention. If the Bekk smoothness (as defined by TAPPI Standard T479 om-81) of the interlayer is less than 50 seconds, the resulting heat-sensitive recording material does not have a surface with a satisfactorily high gloss or a pearlescent matted appearance even if the interlayer is coated with a layer of a resin that is curable upon exposure to electron beams. If a matted surface is provided by, for example, incorporating a pigment into the overcoat layer, no satisfactory results are attained in terms of preservability of recorded images.

If the Bekk smoothness of the interlayer is more than 1,500 seconds, reduction in preservability of recorded images occurs, and the overcoat layer which is to be formed subsequently does not intimately stick to the interlayer, causing various troubles to occur. Therefore, the interlayer should have a Bekk smoothness in the range of from about 50 to 1,500 seconds, preferably from 500 to 1,500 seconds, most preferably from 700 to 1,500 seconds. In order to attain this range of the Bekk smoothness, the surface of the interlayer formed is desirable smoothed by a suitable method such as supercalendaring.

In the heat-sensitive recording material of the present invention, the interlayer thus formed which has the surface smoothness specified hereinabove is overcoated with a layer of a resin that is curable upon exposure to electron beams. This resin overcoat layer is formed of one or more of the following prepolymers of monomers having at least one ethylenically unsaturated double bond in the molecule, that cure upon exposure to electron beams.

Examples of useful electron beam-curable prepolymers include:

(a) Poly(meth)acrylates of aliphatic, alicyclic, or araliphatic polyhydric (having from 2 to 6 alcoholic hydroxyl groups) alcohols or polyalkylene glycols, such as esterified compounds of polyhydric alcohols (e.g., ethylene glycol and propylene glycol) or polyalkylene glycols (e.g., polyethylene glycol) and (meth)acrylic acid.

(b) Poly(meth)acrylates of polyhydric alcohols resulting from addition of alkylene oxides to aliphatic, alicyclic, or araliphatic polyhydric (having from 2 to 6 alcoholic hydroxyl groups) alcohols, such as esterified compounds of polyhydric alcohols resulting from addition of alkylene oxides (e.g., ethylene oxide) to polyhydric alcohols (e.g., pentaerythritol) and (meth)acrylic acid;

(c) Poly(meth)acryloyloxyalykyl phosphates resulting from reaction of hydroxyl group-containing (meth-)acrylates and phosphorus pentoxide, e.g., poly(meth)acryloyloxyethyl phophate;

(d) Polyester poly(meth)acrylates resulting from esterification of (meth)acrylic acid, polyhydric alcohols, and polycarboxylic acids, e.g., di(meth)acrylate of polyester diol between maleic acid and ethylene glycol, di(meth)acrylate of polyester diol between phthalic acid and diethylene glycol, and poly(meth)acrylate of polyester diol between adipic acid and triethylene glycol;

(e) Epoxy poly(meth)acrylates which are a reaction product of (meth)acrylic acid and epoxy resin resulting from reaction of polyhydric phenols and epichlorohydrin, e.g., a reaction product of bisphenol A-diglycidyl ether-based epoxy resin and (meth)acrylic acid;

(f) Polyurethane poly(meth)acrylates such as reaction products of hydroxyl group-containing (meth)acrylates (e.g., 2-hydroxyethyl (meth)acrylate) and diisocyanate;

(g) Polyamide poly(meth)acrylates such as reaction products of polyamide-based polycarboxylic acids (e.g., that resulting from reaction of ethylenediamine and phthalic acid) and hydroxyl group-containing (meth)acrylates (e.g., 2-hydroxyethyl (meth)acrylate);

(h) Polysiloxane poly(meth)acrylates such as reaction products of polysiloxane bond unit-containing polyhydric alcohols and (meth)acrylic acid or hydroxyl group-containing (meth)acrylates;

(i) Low molecular weight vinyl or diene polymers containing (meth)acryloyloxy group in the side chain and/or terminal thereof, such as reaction products of copolymers of (meth)acrylic acid and other vinyl monomer and glycidyl (meth)acrylate; and (j) Modified products of the oligoester (meth)acrylates of (a) to (i) above, such as modified products obtained by modifying a part of the hydroxyl or carboxyl groups remained in the oligoester with an acid chloride, an acid anhydride, or an isocyanate.

Examples of useful electron beam-curable monomers include:

I. Monofunctional Unsaturated Monomers (1) Carboxyl group-containing monomers exemplified by ethylenically unsaturated mono- or polycarboxylic acids (e.g., maleic acid, fumaric acid, and itaconic acid), and carboxylic acid salt group-containing monomers such as alkali metal salts, ammonium salts, and amine salts of the foregoing monomers;

(2) Amide group-containing monomers exemplified by ethylenically unsaturated (meth)acrylamides or alkylsubstituted (meth)acrylamides (e.g., N,N-dimethyl (meth)acrylamide), and vinyl lactams (e.g., N-vinylpyrrolidone);

(3) Sulfonic acid group-containing monomers exemplified by aliphatic or aromatic vinylsulfonic acids, and sulfonic acid salt group-containing monomers such as the alkali metal, ammonium, and amine salts of the foregoing vinylsulfonic acids, e.g., 2-acrylamido-2-methylpropanesulfonic acid;

(4) Hydroxyl group-containing monomers exemplified by ethylenically unsaturated esters of polyols, such as tripropylene glycol mono(meth)acrylate;

(5) Amino group-containing monomers such as dimethylaminoethyl (meth)acrylate and 2-vinylpyridine;

(6) Quaternary ammonium salt group-containing monomers such as N,N,N,-trimethyl-N-(meth)acryloyloxyethylammonium chloride;

(7) Alkyl esters of ethylenically unsaturated carboxylic acids, such as methyl (meth)acrylate and ethyl (meth)acrylate;

(8) Nitrile group-containing monomers such as (meth)acrylonitrile;

(9) Styrene;

(10) Ethylenically unsaturated alcohol esters such as vinyl acetate and allyl acetate; and

(11) Mono(meth)acrylates of alkylene oxide adducts of compounds containing active hydrogen (e.g., monohydric alcohols, phenols, carboxylic acids, amines, and amides).

II. Difunctional Unsaturated Monomers (1) Ester group-containing difunctional monomers exemplified by diesters of polyols and ethylenically unsaturated carboxylic acids, such as trimethylolpropane di(meth)acrylate, and diesters of polybasic acids and unsaturated alcohols, such as diallyl phthalate;

(2) Difunctional diesters of (meth)acrylic acid and alkylene oxide adducts of compounds containing active hydrogen (e.g., polyhydric alcohols, phenols, carboxylic acids, amines, and amides) such as pentanediol propylene oxide adduct;

(3) Bisacrylamides such as N,N-methylenebisacrylamide; and (4) Difunctional compounds such as divinylbenzene, divinylethylene glycol, divinylsulfone, divinyl ether, and divinyl ketone.

III. Polyfunctional Unsaturated Monomers (1) Ester group-containing polyfunctional monomers exemplified by polyesters of polyols and ethylenically unsaturated carboxylic acids, such as trimethylolpropane (meth)acrylate and dipentaerythritol hex(meth)a-crylate, and polyesters of polycarboxylic acids and unsaturated alcohols, such as triallyl trimellitate;

(2) Polyfunctional monomers exemplified by polyesters of alkylene oxide adducts of compounds containing active hydrogen (e.g., polyhydric alcohols, polyhydric phenols, polycarboxylic acids, polyamines, and polyamides) and (meth)acrylic acid; and (3) Polyfunctional unsaturated monomers such as trivinylbenzene.

The amount in which the electron beam-curable resin is coated is not limited to any particular value. However, if this resin is coated in an amount of less than 0.1 $g/m^2$, the intended effects of the present invention cannot be attained. If the resin is coated in an amount of more than 20 $g/m^2$, the recording sensitivity of the resulting heat-sensitive recording material may be reduced markedly. Therefore, the electron beam-curable resin is generally coated in an amount of from about 0.1 to 20 $g/m^2$, preferably from 0.5 to 10 $g/m^2$.

Besides the prepolymers and monomers described above, various additives may optionally be incorporated in the resin component that cures upon exposure to electron beams, and such optional additives include resins that do not cure upon exposure to electron beams, pigments, defoaming agents, levelling agents, lubricants, surfactants, and plasticizers. By appropirately adjusting the types and proportions of such additives used, heat-sensitive recording materials with widely varying surface properties ranging from a high gloss to a matted appearance can be attained.

Illustrative resins that do not cure upon exposure to electron beams include acrylic resins, silicone resins, alkyd resins, fluorocarbon resins, and butyral resins.

The electron beam-curable resin and any other necessary components are intimately mixed by means of a suitable mixer/stirrer such as a mixer, and the resulting mixture is coated on the previously formed interlayer. If necessary, the resin components may be heated to attain a properly adjusted viscosity.

The resin layer formed on the interlayer is then cured by exposure to electron beams, the dose of which generally ranges from about 0.1 to 15 Mrad, preferably from 0.5 to 10 Mrad. The resin component cannot be fully cured if the dose of electron beams is less than 0.1 Mrad. If, on the other hand, the dose of electron beams exceeds 15 Mrad, the heat-sensitive recording material undergoes undesired color formation or discoloration.

Exposure to electron beams may be carried by any conventional technique such as the scanning method, the curtain-beam method, or the broad-beam method. An appropriate acceleration voltage for electron beam exposure ranges from about 100 to 300 kV.

As described above, the heat-sensitive recording material of the present invention has widely varying surface characteristics ranging from a high gloss to a matted appearance because an overcoat layer formed from a prepolymer or monomer that is curable upon exposure to electron beams is provided on an interlayer having a specified Bekk smoothness and exhibits not only superior recording characteristics but also good preservability of recorded images. However, it has been found that if, for instance, a tacky tape is stuck onto the overcoat layer of the recording material and then peeled apart therefrom, a peeling phenomenon of the overcoat layer possibly occurs, hence, it is still unsatisfactory in terms of surface strength.

In order to solve this problem, the present inventors have further made extensive investigations and found that when at least one compound selected from (meth)acrylates having a polar group and specific urethane (meth)acrylates as listed below is incorporated in the electron beam-curable resin layer, the surface strength of the recording material can be improved without impairing the surface characteristics, the preservability of recorded images, and the recording characteristics.

Examples of (meth)acrylates having a polar group which can be used in the present invention include monofunctional or polyfunctional (meth)acrylates having at least one polar group selected from a hydroxyl group, a carboxyl group, an amino group, an alkylamino group, a quaternary ammonium group, a sulfonic group, and a phosphoric group. Among them are preferred (meth)acrylates having at least one polar group selected from a hydroxl group, a carboxyl group, an amino group, and an alkylamino group, with those having a hydroxyl group as the polar group being particularly preferred for attaining the intended effects of the present invention.

Specific examples of monofunctional or polyfunctional (meth)acrylates having a hydroxl group include 2-hydroxyethyl acrylate, 2-hydroxypropyl acrylate, pentaerythritol triacrylate, 2-hydroxy-3-phenoxypropyl acrylate, bis(acryloxyethyl)hydroxethyl isocyanurate, N-methylolacrylamide, a urethane (meth)acrylate that is a reaction product between isocyanatoethyl (meth)acrylate and a polyhydric alcohol, and bifunctional acrylates represented by the formula:

$$A-X-A$$

$$CH_2{=}CHCO_2CH_2\overset{\overset{\displaystyle OH}{|}}{C}HCH_2-;$$

X is $-O-(CH_2)_l-O-$ in which l is from 2 to 6, $-O-(C_2H_4O)_m-$ in which m is from 1 to 3, $-O-C_3H_6O-)_n-$ in which n is from 1 to 3,

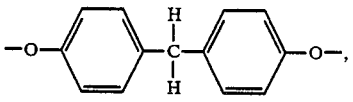

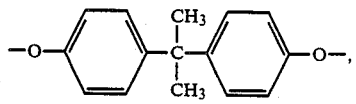

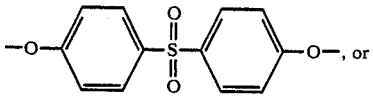

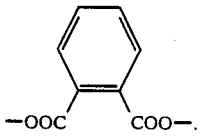

Specific examples of monofunctional or polyfunctional (meth)acrylates having a carboxyl group include esters of 2-hydroxyethyl acrylate with polybasic acids such as maleic acid, fumaric acid, itaconic acid, succinic acid, glutaric acid, adipic acid, phthalic acid, isophthalic acid, terephthalic acid, and trimellitic acid.

Specific examples of monofunctional or polyfunctional (meth)acrylates having an amino group or an alkylamino group include N,N-dimethylaminoethyl acrylate, N,N-dimethylaminoethyl methacrylate, N,N-diethylaminoethyl acrylate, and N,N-diethylaminoethyl methacrylate.

Specific examples of monofunctional or polyfunctional (meth)acrylates having a quaternary ammonium group include methylsulfuric acid-N,N,N-trimethyl-N-methacryloxyethylammonium.

Specific examples of monofunctional or polyfunctional (meth)acrylates having a sulfonic group include sodium methacryloxyethylsulfonate.

Specific examples of monofunctional or polyfunctional (meth)acrylates having a phosphoric group include methacryloyloxyethylphosphate and dimethyacryloyloxyethylphosphate.

Examples of specific urethane (meth)acrylates which can be used in the present invention include:

(1) urethane (meth)acrylates that are a reaction product between a (meth)acrylate monomer having one hydroxyl group and isocyanatoethyl (meth)acrylate;

(2) urethane (meth)acrylates that are a reaction product between a (meth)acrylate monomer having one hydroxyl group and an isocyanic ester represented by formula (I):

$$R—N=C=O \quad (I)$$

wherein R is a lower alkyl group or a lower alkenyl group; and (3) polyurethane poly(meth)acrylates that are a reaction product between a polyhydric alcohol and isocyanatoethyl (meth)acrylate.

Specific examples of the (meth)acrylate monomer having one hydroxyl group which can be used for synthesizing such specific urethane (meth)acrylates in the present invention include 2-hydroxyethyl acrylate, 2-hydroxypropyl acrylate, 2-hydroxy-3-phenoxypropyl acrylate, 2-hydroxy-3-methoxypropyl acrylate, pentaerythritol triacrylate, and N-methylolacrylamide.

Specific examples of the isocyanic esters which can be used include lower alkyl esters of isocyanic acid such as methyl isocyanate, ethyl isocyanate, propyl isocyanate, isopropyl isocyanate, and isobutyl isocyanate; and lower alkenyl esters of isocyanic acid such as vinyl isocyanate and isopropenyl isocyanate.

Specific examples of the polyhydric alcohol which can be used include ethylene glycol, diethylene glycol, triethylene glycol, propylene glycol, dipropylene glycol, neopentyl glycol, glycerin, trimethylolpropane, and pentaerythritol.

The content of the monofunctional or polyfunctional (meth)acrylate having a polar group or specific urethane (meth)acrylate in the electron beam-curable resin is generally from about 1 to 90% by weight, preferably from 3 to 70% by weight, and most preferably from 5 to 40% by weight.

The following examples are provided for the purpose of further illustrating the present invention but are in no sense to be taken as limiting. In the folliwing examples, all parts and percents are on a weight basis unless otherwise specified.

EXAMPLE 1

(1) Preparation of Dispersion A:

| | |
|---|---|
| 3-(N—Cyclohexyl-N—methylamino)-6-methyl-7-phenylaminofluoran | 10 parts |
| Methyl cellulose (5% aq. sol.) | 5 parts |
| Water | 30 parts |

A mixture of these components are pulverized by means of a sand mill to an average particle diameter of 3 μm.

(2) Preparation of Dispersion B:

| | |
|---|---|
| Benzyl 4-hydroxybenzoate | 20 parts |
| Methyl cellulose (5% aq. sol.) | 5 parts |
| Water | 55 parts |

A mixture of these components are pulverized by means of a sand mill to an average particle diameter of 3 μm.

(3) Formation of Recording Layer:

Forty-five parts of Dispersion A, 80 parts of Dispersion B, 50 parts of an aqueous solution of 20% oxidized starch, and 10 parts of water were mixed under agitation to make a coating composition. This coating composition was coated on a sheet of base paper (50 g/m$^2$) in a dry coating weight of 6 g/m$^2$ and subsequently dried to make a heat-sensitive recording paper.

(4) Formation of Interlayer:

A coating composition having the composition shown below was applied to the recording layer of the heat-sensitive recording paper in a dry coating weight of 4 g/m$^2$ and subsequently dried to form an interlayer having a Bekk surface smoothness as defined by TAPPI Standard T479 om-81 (hereinafter the same) of 45 seconds.

| | |
|---|---|
| Polyvinyl alcohol (PVA-117 ®, a trade name of Kuraray Co., Ltd.) (8% aq. sol.) | 1,000 parts |
| Calcium carbonate (Softon ® 1800, a trade name of Bihoku Funka K. K.) | 100 parts |
| Water | 100 parts |

The resulting interlayer was supercalendered to provide a Bekk smoothness of 500 seconds.

(5) Formation of Overcoat Layer:

The interlayer was overcoated with polyacrylate (78 E204 ®, a trade namde of Mobil Oil Corp.) in a dry coating weight of 5 g/m$^2$. The resin components in the applied layer were cured by exposure to electron beams for a total dose of 3 Mrad with an electron curtain-type electron beam irradiator (Model CB:150 of ESI Corporation). As a result, a heat-sensitive recording paper with an overcoat layer of electron beam-cured resin was produced.

EXAMPLE 2

A heat-sensitive recording paper with an overcoat layer of electron beam-cured resin was formed as in Example 1 except that the polyvinyl alcohol used as the water-soluble high molecular weight compound in the interlayer was replaced by an acetoacetylated polyvinyl alcohol (Z-200 ®, a trade name of The Nippon Synthetic Chemical Industry Co., Ltd.).

EXAMPLE 3

A heat-sensitive recording paper with an overcoat layer of electron beam-cured resin was formed as in Example 1 except that the interlayer was supercalendared to attain a Bekk smoothness of 1,000 seconds.

EXAMPLE 4

A heat-sensitive recording paper with an overcoat layer of electron beam-cured resin was formed as in Example 1 except that the polyacrylate used as the overcoat layer-forming resin was replaced by a polyester acrylate prepolymer (M-8030®, a trade name of Toagosei Chemical Industry Co., Ltd.).

EXAMPLE 5

A heat-sensitive recording paper with an overcoat layer of electron beam-cured resin was formed as in Example 1 except that the interlayer was supercalendared to attain a Bekk smoothness of 80 seconds.

EXAMPLE 6

A heat-sensitive recording paper with an overcoat layer of electron beam-cured resin was formed as in Example 2 except that the interlayer was supercalendered to attain a Bekk smoothness of 800 seconds.

EXAMPLE 7

A heat-sensitive recording paper with an overcoat layer of electron beam-cured resin was formed as in Example 3 except that the polyacrylate used as the overcoat layer-forming resin was replaced by a polyester acrylate prepolymer (M-8030®).

EXAMPLE 8

A heat-sensitive recording paper with an overcoat layer of electron beam-cured resin was formed as in Example 3 except that the polyacrylate used as the overcoat layer-forming resin was replaced by a coating composition having the following formulation.

| | |
|---|---|
| Polyester acrylate prepolymer (M-8030 ®) | 100 parts |
| Silica | 5 parts |

The thus prepared recording paper had a pearlescent matted appearance.

COMPARATIVE EXAMPLE 1

A heat-sensitive recording paper was prepared as in Example 1 except that the initially formed interlayer having a Bekk smoothness of 45 seconds was not supercalendered and was immediately provided with an overcoat layer of electron beam-cured resin.

COMPARATIVE EXAMPLE 2

A heat-sensitive recording paper with an overcoat layer of electron beam-cured resin was prepared as in Example 1 except that the interlayer was supercalendered to have a Bekk surface smoothness of 2,000 seconds.

COMPARATIVE EXAMPLE 3

A heat-sensitive recording paper was prepared as in Example 1 except that no overcoat layer was formed on the interlayer.

COMPARATIVE EXAMPLE 4

A heat-sensitive recording paper was prepared as in Example 1 except that the polyacrylate used as the overcoat layer-forming resin was replaced by an ultraviolet light-curable resin (mixture of acrylate prepolymer and photosensitizer: UV-Cote® 50 P-326, a trade name of Nippon Paint Co., Ltd.) and that exposure to electron beams was replaced by a 5-second exposure to ultraviolet radiation under a high pressure mercury vapor lamp (80 watts).

COMPARATIVE EXAMPLE 5

A heat-sensitive recording paper was prepared as in Example 8 except that the initially formed interlayer having a Bekk smoothness of 45 seconds was not supercalendered and was immediately provided with an overcoat layer of electron beam-cured resin. The thus prepared recording paper had a matted appearance but did not exhibit a pearlescent gloss.

Thirteen samples of heat-sensitive recording paper were recorded with a thermal gradient tester (a product of Toyo Seiki K.K.; testing conditions: 120° C., 2 kg/cm$^2$, 10 sec), and the initial color densities of the recorded images were measured with a Macbeth densitometer (Model RD-100R of Macbeth Corporation). The results are shown in Table 1.

Each of the samples of heat-sensitive recording paper was tested for its resistance to plasticizer and oil by the methods described below. The color density of the recorded image was thereafter measured with a Macbeth densitometer, and the results are also shown in Table 1. The gloss of the surface of each sample was measured before recording, and the results of the measurement are also shown in Table 1.

Resistance to plasticizer:

A polypropylene pipe (40 mm$\phi$) was wrapped with three layers of polyvinyl chloride film (a product of Mitsui Toatsu Chemicals, Inc.) and a sample of heat-sensitive recording paper on which an image had been recorded with a thermal gradient tester was placed over the PVC film with the recorded side facing outward; the heat-sensitive recording paper was further wrapped with five layers of PVC film, and the color density of the recorded image was measured 72 hours later (the higher the color density, the more resistant to plasticizer the sample was).

Resistance to oil:

After an image was recorded on a sample of heat-sensitive recording paper, 0.05 cc of salad oil was dropped on the recording layer and spread uniformly over its surface; 24 hours later, the color density of the recorded image was measured (the higher the color density, the more oil resistant the sample was).

Gloss:

Measured with a varied-angle photometer at an incident angle of 60 degrees (the higher the value that was obtained, the higher the gloss of the sample tested).

TABLE 1

| | Bekk smoothness (sec) | Initial color density of recorded image | Resistance to plasticizer | Oil resistance | Gloss |
|---|---|---|---|---|---|
| Example | | | | | |
| 1 | 500 | 1.30 | 1.26 | 1.25 | 90 |
| 2 | 500 | 1.30 | 1.28 | 1.27 | 90 |
| 3 | 1,000 | 1.32 | 1.29 | 1.27 | 92 |
| 4 | 500 | 1.29 | 1.25 | 1.25 | 90 |
| 5 | 80 | 1.29 | 1.26 | 1.25 | 80 |
| 6 | 800 | 1.32 | 1.30 | 1.29 | 92 |

TABLE 1-continued

| | Bekk smoothness (sec) | Initial color density of recorded image | Resistance to plasticizer | Oil resistance | Gloss |
|---|---|---|---|---|---|
| 7 | 1,000 | 1.30 | 1.28 | 1.27 | 91 |
| 8 | 1,000 | 1.30 | 1.27 | 1.26 | A* |
| Comparative Example | | | | | |
| 1 | 45 | 1.27 | 1.25 | 1.24 | 70 |
| 2 | 2,000 | 1.30 | 1.13 | 1.11 | 90 |
| 3 | 500 | 1.28 | 1.10 | 1.10 | 6 |
| 4 | 500 | 1.29 | 1.13 | 1.12 | 55 |
| 5 | 45 | 1.26 | 1.14 | 1.13 | B* |

A* matted appearance having a pearlescent gloss
B* matted appearance having no pearlescent gloss As the data in Table 1 show, the samples of heat-sensitive recording material prepared in accordance with the present invention had a high surface gloss and exhibited very good preservability of recorded images.

EXAMPLE 9

A heat-sensitive recording paper with an overcoat layer of electron beam-cured resin was formed as in Example 3 except that the polyacrylate used as the overcoat layer-forming resin was replaced by a mixture comprising 80 parts of a polyester acrylate prepolymer (M-8030®) and 20 parts of pentaerythritol triacrylate.

EXAMPLE 10

A heat-sensitive recording paper with an overcoat layer of electron beam-cured resin was formed as in Example 3 except that the polyacrylate used as the overcoat layer-forming resin was replaced by a mixture comprising 80 parts of a polyester acrylate prepolymer (M-8030®) and 20 parts of 2-hydroxy-3-phenoxypropyl acrylate.

EXAMPLE 11

A heat-sensitive recording paper with an overcoat layer of electron beam-cured resin was formed as in Example 3 except that the polyacrylate used as the overcoat layer-forming resin was replaced by a mixture comprising 80 parts of a polyester acrylate prepolymer (M-8030®) and 20 parts of a urethane acrylate represented by the formula:

$$CH_2\underset{\underset{O}{\|}}{CHCOCH_2CH_2NHCOCH_2CH_2OH}$$

that is a reaction product between isocyanatoethyl acrylate and ethylene glycol.

EXAMPLE 12

A heat-sensitive recording paper with an overcoat layer of electron beam-cured resin was formed as in Example 3 except that the polyacrylate used as the overcoat layer-forming resin was replaced by a mixture comprising 80 parts of a polyester acrylate prepolymer (M-8030®) and 20 parts of acryloxyethyl phthalate.

EXAMPLE 13

A heat-sensitive recording paper with an overcoat layer of electron beam-cured resin was formed as in Example 3 except that the polyacrylate used as the overcoat layer-forming resin was replaced by a mixture comprising 80 parts of a polyester acrylate prepolymer (M-8030®) and 20 parts of N,N-dimethylaminoethyl acrylate.

EXAMPLE 14

A heat-sensitive recording paper with an overcoat layer of electron beam-cured resin was formed as in Example 3 except that the polyacrylate used as the overcoat layer-forming resin was replaced by a mixture comprising 80 parts of a polyester acrylate prepolymer (M-8030®) and 20 parts of a urethane acrylate represented by the formula:

$$CH_2{=}\overset{\overset{CH_3}{|}}{C}\underset{\underset{O}{\|}}{-COCH_2CH_2NHCOCH_2CH_2OCCH}{=}CH_2$$

that is a reaction product between isocyanatoethyl methacrylate and 2-hydroxyethyl acrylate.

EXAMPLE 15

A heat-sensitive recording paper with an overcoat layer of electron beam-cured resin was formed as in Example 3 except that the polyacrylate used as the overcoat layer-forming resin was replaced by a mixture comprising 80 parts of a polyester acrylate prepolymer (M-8030®) and 20 parts of a urethane acrylate represented by the formula:

$$CH_2{=}\underset{\underset{O}{\|}}{CHCOCH_2CH_2NHCOCH_2}\overset{\overset{CH_3}{|}}{C}\underset{\underset{O}{\|}}{HOCCH}{=}CH_2$$

that is a reaction product between isocyanatoethyl acrylate and 1-methyl-2-hydroxyethyl acrylate.

EXAMPLE 16

A heat-sensitive recording paper with an overcoat layer of electron beam-cured resin was formed as in Example 3 except that the polyacrylate used as the overcoat layer-forming resin was replaced by a mixture comprising 80 parts of a polyester acrylate prepolymer (M-8030®) and 20 parts of a urethane acrylate represented by the formula:

$$CH_2{=}\underset{\underset{O}{\|}}{CHCOCH_2CH_2O-CNHCH_3}$$

that is a reaction product between methyl isocyanate and 2-hydroxethyl acrylate.

EXAMPLE 17

A heat-sensitive recording paper with an overcoat layer of electron beam-cured resin was formed as in Example 3 except that the polyacrylate used as the overcoat layer-forming resin was replaced by a mixture comprising 80 parts of a polyester acrylate prepolymer (M-8030®) and 20 parts of a polyurethane polyacrylate represented by the formula:

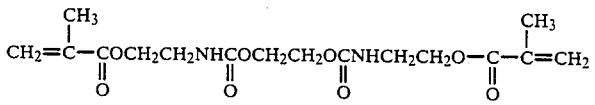

that is a reaction product between isocyanatoethyl methacrylate and ethylene glycol.

The thus prepared 9 samples of heat-sensitive recording paper were evaluated in terms of initial color density of recorded image, resistance to plasticizer, oil resistance, and gloss. The results are shown in Table 2.

Further, these 9 samples of heat-sensitive recording paper as well as the heat-sensitive recording paper as prepared in Example 7 for comparison were evaluated with respect to the surface strength of overcoat layer in accordance with the following method. The results are also shown in Table 2.

Surface strength:

A cellophane adhesive tape (a product of Nitto Co., Ltd.) was stuck onto the surface of the overcoat layer and peeled apart therefrom. Then, the peeling state of the resulting overcoat layer was visually evaluated under the following criterion.

O: The overcoat layer did not change at all.

Δ: The overcoat layer was observed to be slightly peeled apart.

TABLE 2

| Example No. | Initial color density of recorded image | Resistance to plasticizer | Oil resistance | Surface strength | Gloss (%) |
|---|---|---|---|---|---|
| 9 | 1.32 | 1.30 | 1.32 | O | 91 |
| 10 | 1.31 | 1.31 | 1.31 | O | 91 |
| 11 | 1.29 | 1.28 | 1.27 | O | 90 |
| 12 | 1.31 | 1.30 | 1.30 | O | 90 |
| 13 | 1.30 | 1.28 | 1.28 | O | 90 |
| 14 | 1.30 | 1.29 | 1.28 | O | 90 |
| 15 | 1.30 | 1.29 | 1.28 | O | 90 |
| 16 | 1.31 | 1.29 | 1.27 | O | 91 |
| 17 | 1.30 | 1.28 | 1.28 | O | 90 |
| 7 | 1.30 | 1.28 | 1.27 | Δ | 91 |

As the data in Table 2 show, the samples of heat-sensitive recording material prepared in accordance with the present invention, having a monofunctional or polyfunctional (meth)acrylate having a specified polar group or a specific urethane (meth)acrylate incorporated in the electron beam-curable resin layer were excellent in not only surface characteristics, preservability of recorded images, and recording characteristics but also surface strength of the overcoat layer.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support; a heat-sensitive recording layer formed on said support, which contains a color former and a color developer which forms a color upon contact with said color former; an interlayer with a Bekk smoothness as defined by TAPPI Standard T479 om-81 of from 50 to 1500 seconds formed on said heat-sensitive recording layer, which contains a water-soluble resin; and an overcoat formed on said interlayer, said overcoat layer comprising a resin which has been cured by exposure to electron beams.

2. A heat-sensitive recording material as in claim 1, wherein said interlayer has a Bekk smoothness of from 500 to 1,500 seconds.

3. A heat-sensitive recording material as in claim 1, wherein said resin which has been cured by exposure to electron beams comprises, prior to being cured by exposure to electron beams, a monofunctional or polyfunctional acrylate or methacrylate having at least one polar group selected from a group consisting of a hydroxyl group, a carboxyl group, an amino group, an alkylamine group, a quaternary ammonium group, a sulfonic group, and a phosphoric group.

4. A heat-sensitive recording material as in claim 3, wherein said resin which has been cured by exposure to electron beams comprises, prior to being cured by exposure to electron beams, a monofunctional or polyfunctional acrylate or methacrylate having at least one polar group selected from the group consisting of a hydroxyl group, a carboxyl group, an amino group, and an alkylamino group.

5. A heat-sensitive recording material as in claim 1, wherein said resin which has been cured by exposure to electron beams comprises, prior to being cured by exposure to electron beams, a urethane acrylate or urethane methacrylate that is a reaction product between an acrylate monomer or methacrylate monomer having one hydroxyl group and isocyanatoethyl acrylate, isocyanatoethyl methacrylate, or an isocyanic ester represented by formula (I):

$$R-N=C=O \qquad (I)$$

wherein R is a lower alkyl group or a lower alkyenyl group.

6. A heat-sensitive recording material as in claim 1, wherein said resin which has been cured by exposure to electron beams comprises, prior to being cured by exposure to electron beams, a polyurethane polyacrylate or polyurethane polymethyacrylate that is a reaction product between a polyhydric alcohol and isocyanatoethyl acrylate or isocyanatoethyl methacrylate.

* * * * *